US005885146A

United States Patent [19]

Cockburn

[11] Patent Number: 5,885,146

[45] **Date of Patent: *Mar. 23, 1999**

[54] OSCILLATING HAND TOOL

[75] Inventor: Eric Cockburn, Spennymoor, United Kingdom

[73] Assignee: Black & Decker Inc., Newark, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 918,485

[22] Filed: Aug. 25, 1997

Related U.S. Application Data

[63] Continuation of Ser. No. 569,405, Dec. 6, 1995, abandoned.

[51] Int. Cl.[6] ..... B24B 23/00; B24B 27/08

[52] U.S. Cl. ..... 451/357; 451/344; 451/490

[58] Field of Search ..... 451/357, 344, 451/342, 366, 441, 451, 508, 510, 511, 490, 493, 495, 496, 499, 501, 512, 516

[56] References Cited

U.S. PATENT DOCUMENTS

| | | | |
|---|---|---|---|
| 2,817,192 | 12/1957 | Amsden | 451/344 |
| 3,345,784 | 10/1967 | Stelljes et al. | 451/357 |
| 3,436,875 | 4/1969 | Cheney | 451/508 |
| 3,533,193 | 10/1970 | Dudek et al. | 451/357 |
| 3,742,656 | 7/1973 | Amos | 451/508 |
| 3,864,784 | 2/1975 | Kilstrom et al. | 451/357 |
| 3,943,669 | 3/1976 | Stroezel | 451/357 |
| 4,137,617 | 2/1979 | Newmayer . | |
| 4,222,297 | 9/1980 | Jackson . | |
| 4,468,895 | 9/1984 | Signorelli . | |
| 4,497,141 | 2/1985 | Jarby | 451/342 |
| 4,708,041 | 11/1987 | Granger . | |
| 4,729,194 | 3/1988 | Maier et al. | 451/357 |
| 4,907,374 | 3/1990 | Brill . | |
| 4,943,178 | 7/1990 | Weinstein . | |
| 5,061,090 | 10/1991 | Kriaski et al. | 451/357 |
| 5,468,176 | 11/1995 | Udert et al. . | |

FOREIGN PATENT DOCUMENTS

| | | |
|---|---|---|
| 0541275 | 5/1993 | European Pat. Off. . |
| 0559020 | 9/1993 | European Pat. Off. . |
| 596831 | 5/1994 | European Pat. Off. . |
| 2512438 | 11/1975 | Germany . |
| 3714148 | 11/1987 | Germany . |
| 3724698 | 2/1989 | Germany . |
| 4306829 | 9/1994 | Germany . |
| 8803076 | 5/1988 | WIPO . |
| 9317828 | 9/1993 | WIPO . |

*Primary Examiner*—Timothy V. Eley
*Assistant Examiner*—Derris H. Banks
*Attorney, Agent, or Firm*—Bruce S. Shapiro; Dennis A. Dearing; John D. Del Ponti

[57] ABSTRACT

A dual function powered oscillating hand tool comprises a driven unit having an electric motor and a first drive shaft; an eccentric bearing mounted on the first drive shaft with a radial offset e relative to the first drive shaft; a second drive shaft mounted on the eccentric bearing and terminating in a flange and a drive spigot; a sanding shoe; and a location hole positioned on the backing face of the sanding shoe for location of the second drive shaft and means to restrict the random orbit of the sanding shoe to a regular orbit. The drive spigot has a diameter $d_1$ adjacent to the flange face and a maximum diameter $d_2$ at its free end and the location hole has a diameter $d_3$ at the backing face and a diameter $d_4$ at the face adjacent to the working face of the shoe, and $$d_1=d_3-c_1$$

$$d_2=d_4-c_2 \text{ and}$$

$$d_2=d_3-(2e-c_1)$$

where $c_1$ is the clearance between the drive spigot and the location hole at the flange face when the shoe is mounted on the second drive shaft and $c_2$ is the clearance between the drive spigot and the location hole at the face of the location hole adjacent to the working face when the shoe is mounted on the second drive shaft.

2 Claims, 3 Drawing Sheets

OSCILLATING HAND TOOL

This application is a continuation of application Ser. No. 08/569,405, filed on Dec. 6, 1995, now abandoned.

The present invention relates to a powered oscillating hand tool, in particular an orbital sander, comprising a drive unit having an electric motor with a drive shaft to which a working head, for example a sanding shoe can be attached.

In sanders of the orbital type, with a shaped shoe, the drive system comprises an eccentric which is restrained so that the sander shoe cannot spin independently of the motor and it therefore describes a regular orbit. The shoes of such sanders are available in a range of shapes and such sanders are in general used for the removal of relatively small quantities of material, for example for detailed work or for finishing. By choice of a suitably shaped shoe, it is possible to access areas which are inaccessible with a random orbit sander.

The restraining mechanism by which the eccentric is restrained so that the sander shoe cannot spin independently of the motor and therefore describes a regular orbit, generally comprises a co-operating array of legs and spigots on the shoe and the sander body respectively. In order to avoid problems resulting from the system being out of balance, it is necessary for the location hole on the shoe, in which the drive shaft locates, to be centrally positioned on the shoe. This leads to difficulties in locating the location hole of the shoe on the second (eccentric) drive shaft at the same time as locating the corresponding legs and spigots. For the shaft to match the location hole on the shoe, it is necessary to deform the legs during this location. This has in practice meant that it has not been usual to provide orbital sanders with interchangeable, differently shaped shoes so that the user has generally had to purchase more than one orbital sander in order to have available a selection of differently shaped shoes.

Known sanders have hence been either of the orbital type as described above, with a fixed shoe or of the random orbit type in which a circular platen is driven by a drive system which comprises an eccentric bearing so that the platen can spin independently of the motor, and the platen describes a random orbit.

This has meant that when the user wished to have the ability to perform both coarse and detailed sanding operations, or to use differently shaped sanding shoes in order to access difficult areas it has been necessary for him to purchase two or more separate units of different types, or to purchase only one unit and suffer the disadvantages thereof.

It is a further disadvantage of the known sanders that the drive shaft to which the sander head is attachable, and the hole by which the head is mounted on the shaft are each of generally circular section, flatted on opposite faces to assist in retaining the head on the sander. This design is more expensive to manufacture than a circular section and has the further disadvantage that when the user locates the head on the shaft, it is necessary to align the opposed flats on the shaft and head correctly, in order to avoid damage to the head or the shaft.

It is an object of the present invention to provide a powered oscillating hand tool comprising a drive unit having an electric motor with a drive shaft to which a sander head can be attached, in which the attachment means by which the sander head is attachable to the drive shaft is particularly convenient.

The present invention therefore provides a powered oscillating hand tool comprising (i) a drive unit having an electric motor and a first driveshaft;

(ii) an eccentric bearing mounted on the first drive shaft with a radial offset e relative to the first drive shaft;

(iii) a second drive shaft mounted on the eccentric bearing and terminating in a drive spigot;

(iv) a sanding shoe;

(v) a location hole positioned on the backing face of the sanding shoe for location of the second drive shaft and (vi) means to restrict the random orbit of the sanding shoe to a regular orbit, characterised in that the drive spigot has a diameter $d_1$ adjacent to the second end (36) of the second drive shaft and a maximum diameter $d_2$ at its free end and the location hole has a diameter $d_3$ at the backing face and a diameter $d_4$ at the face adjacent to the working face of the shoe, and $$d_1=d_3-c_1$$

$$d_2=d_4-c_2 \text{and}$$

$$d_2=d_3-(2e-c_1)$$

where $c_1$ is the clearance between the drive spigot and the location hole at the face of the location hole adjacent to the backing face when the shoe is mounted on the second drive shaft and $c_2$ is the clearance between the drive spigot and the location hole at the face of the location hole adjacent to the working face when the shoe is mounted on the second drive shaft.

The attachment means according to the invention by which the sander head is attachable to the drive shaft is suitable for use in any powered oscillating hand tool which is provided with interchangeable heads and is particularly suitable for use in a dual function powered oscillating hand tool comprising (i) a drive unit having an electric motor and a drive shaft;

(ii) a bearing mounted on the drive shaft and located radially eccentrically relative to the drive shaft;

(iii) a second drive shaft mounted in the eccentric bearing and (iv) means for mounting a sanding platen or shoe on the second drive shaft characterised in that the sanding head may comprise a sanding platen for random orbit sanding or a sanding shoe for orbital sanding and in that the tool further comprises means selectively engageable to restrict the random orbit of the sanding shoe to a regular orbit, as described and claimed in our co-pending U.S. patent application Ser. No. 08/701,568 which is a continuation of U.S. application Ser. No. 08/503,109 now abandoned.

The invention thus provides a powered oscillating power tool which can easily be fitted with an orbital sander shoe or with an alternative sander head, such as a differently shaped sanding shoe or a random orbit sander head without requiring deformation of the restraining legs.

The invention will now be further described with reference to the accompanying drawings in which FIG. 1 is a side view, partially in section, of the drive unit of a first embodiment of a hand tool according to the present invention, fitted with an orbital sander shoe;

FIG. 4 is an enlarged portion of FIG. 1 showing a drive spigot located within a hole of a sanding shoe.

Figure 1:
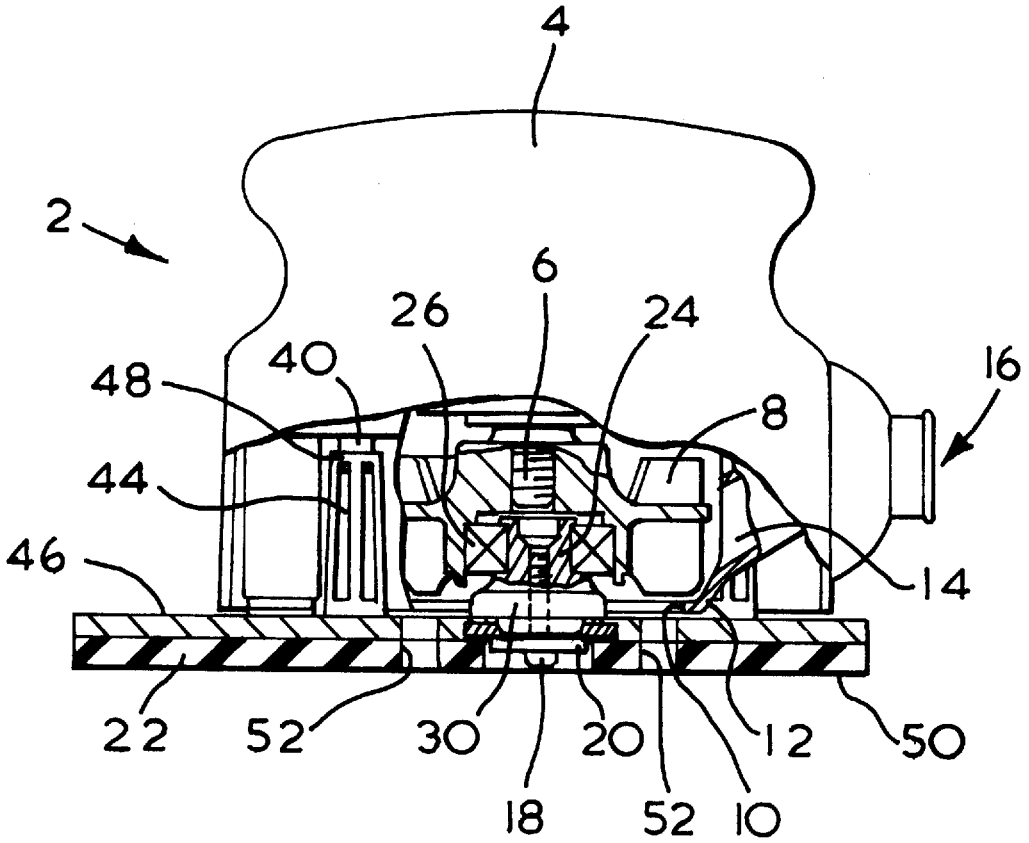
Figure 2:
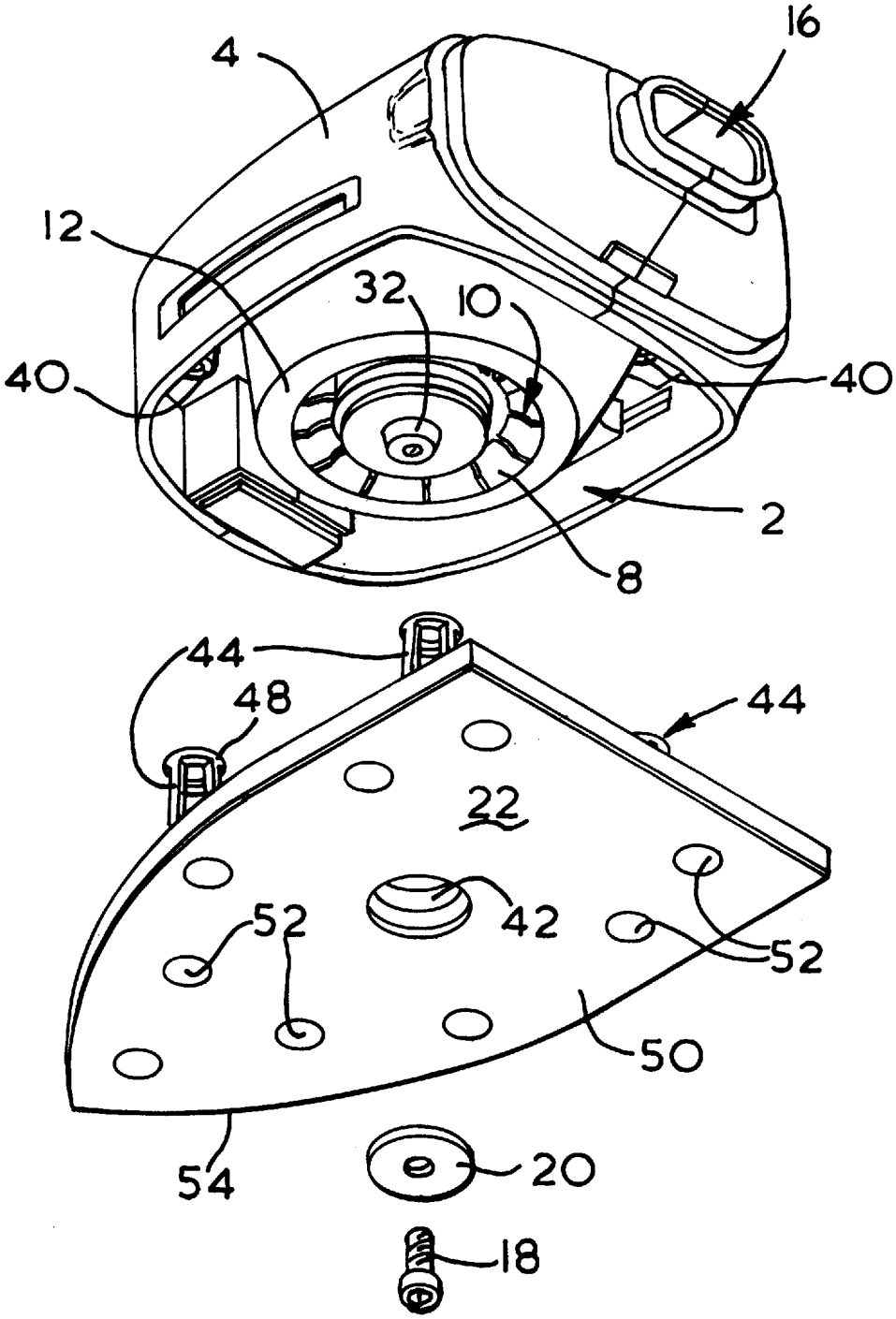
FIG. 2 is an exploded view of the sanding shoe and drive shaft of FIG. 1

FIGS. 1 and 2 show a drive unit (2) including an electric motor (not shown) located in upper housing (4) and driving shaft (6). A fan (8) mounted on shaft (6) is arranged to draw air in from mouth (10) of lower housing (12) and direct it through extractor duct (14) to exhaust outlet (16). A screw (18) and washer (20) are used to secure a sanding shoe (22) to a second drive shaft (24) which is housed in the fan (8) by bearing (26) which is eccentrically located radially in respect to shaft (8).

The second drive shaft (24) comprises a first section (28), a flange (30) and a drive spigot (32). A first end (34) of the first section (28) is adapted for mounting in the bearing (26) and the flange (30) is mounted on the first section (28) at the second end (36) of the first section.

The second drive shaft (24) terminates in a drive spigot (32).

Two pairs of spigots (40) are arranged in an array within the lower housing (12), around the mouth (10) of the housing (12).

The sanding shoe (22) is provided with a location hole (42) for location of the drive spigot (32). Two pairs of hollow, tapering, flexible columns (44) made of rubber are arranged, in an array matching that of the housing spigots (40), on the backing face (46) of the shoe (22).

When the sanding shoe (22) is mounted on the second drive shaft (24), the tips (48) of the flexible columns (44) formed on the backing face (46) of the shoe (22) engage the housing spigots (40).

A perforated sandpaper sheet (not shown) may be attached to the outer face (50) of the shoe (22), for example by the use of hook-and-loop fabric such as that sold as VELCRO (RTM) glued to face (50). Holes (52) passing through the shoe (22) facilitate the removal of dust etc, from the sanding face through the shoe (22) to exhaust outlet (16) via the duct (14). An extractor hose (not shown) may be attached to the exhaust outlet (16).

Figure 3:
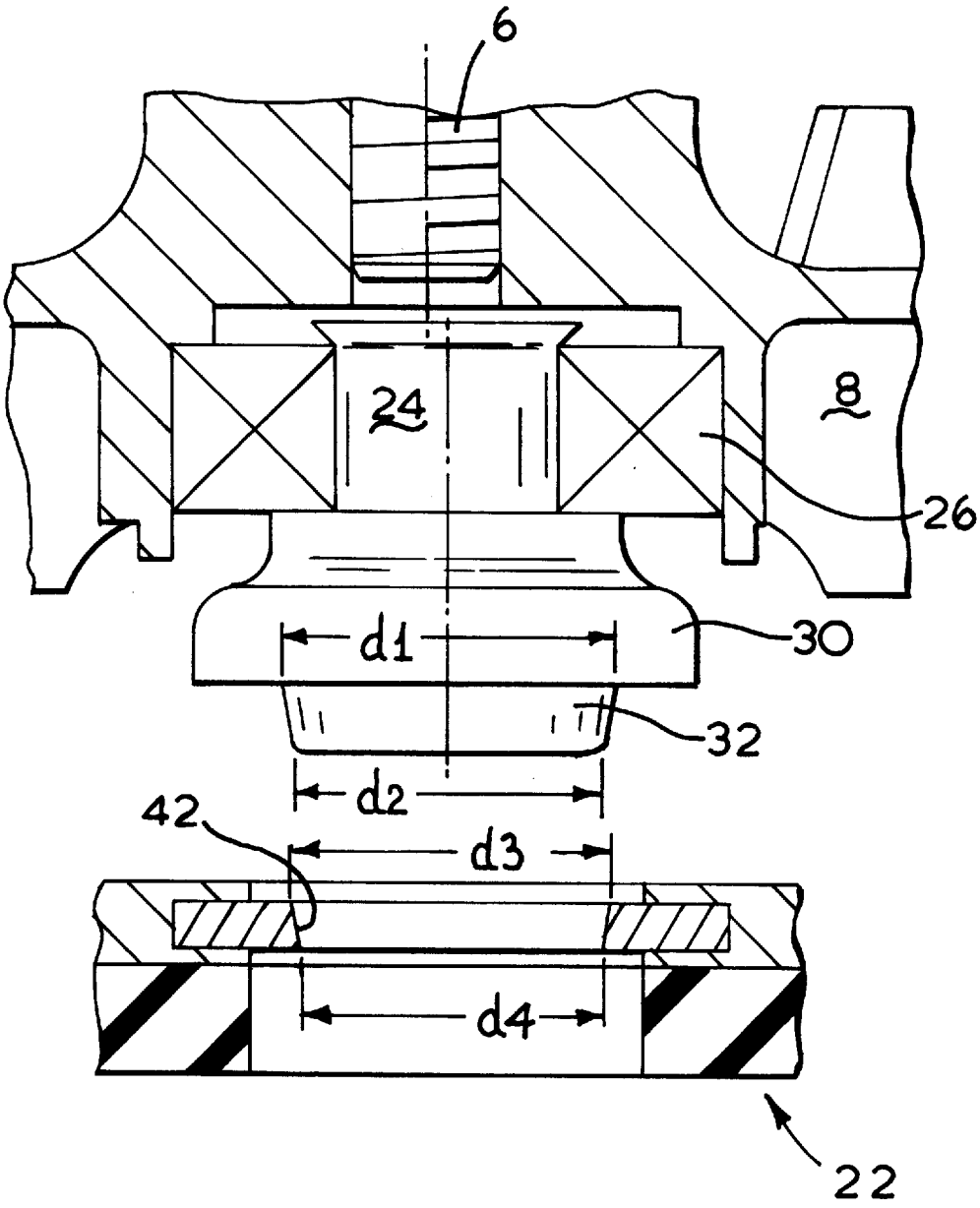
FIG. 3 is a section, on an enlarged scale, on a part of the tool according to FIGS. 1 and 2.

As is shown in FIG. 3, the second drive shaft (24) comprises a first section (28), a flange (30) and a drive spigot (32). A first end (34) of the first section (28) is adapted for mounting in the bearing (26) and the flange (30) is mounted on the first section (28) at the second end (36) of the first section. The second drive shaft (24) terminates in the drive spigot (32).

The drive spigot (32) tapers from a diameter $d_1$ at its face adjoining the flange (30) to a diameter $d_2$ at its free end. The location hole (42) of the shoe (22) has a diameter $d_3$ at the backing face (46) of the shoe (22), and a diameter $d_4$ at the outer face (50) of the shoe (22).

The motor axis $A_M$ is offset from the axis $A_B$ of the eccentric bearing (26) by a radial eccentricity e.

As shown in FIG. 4, when the tool is assembled, with the shoe (22) mounted on the drive shaft (24), there is a clearance $c_1$, at the level of the backing face of the shoe, between the drive spigot (32) and the location hole (42) and a clearance $C_2$ at the level of the outer face.

In order to exchange a first shoe for an alternative shoe, the first shoe is removed and the alternative shoe is located an the second drive shaft.

The flexible columns (44) are located on the spigots (40) and the drive spigot (32) of the second drive shaft (24) is aligned sufficiently with the location hole (42) of the shoe (22) for the drive spigot (32) to be guided into the location hole (4) as the screw (18) is tightened and the shoe (22) secured to the second drive shaft (24).

While the powered oscillating hand tool according to the invention is particularly adapted for use with sanding heads such as orbital sanding shoes and random orbit sanding platens, it is of course within the scope of the invention to provide a tool to which further alternative oscillating heads can be attached.

I claim:

1. A dual function powered oscillating hand tool comprising (i) a drive unit (2) having an electric motor and a first drive shaft (6);

(ii) an eccentric bearing (26) mounted on the first drive shaft (6) with a radial offset e relative to the first drive shaft (6);

(iii) a second drive shaft (24) mounted on the eccentric bearing (26) and terminating in a drive spigot (38);

(iv) a sanding shoe (22);

(v) a location hole (42) positioned on the backing face (46) of the sanding shoe (22) for location of the second drive shaft (24) and (vi) means (40,44) to restrict the random orbit of the sanding shoe (22) to a regular orbit, characterized in that the drive spigot (32) has a diameter $d_1$ adjacent to the second end (36) of the second drive shaft (24) and a maximum diameter $d_2$ at its free end (36) and the location hole (42) has a diameter $d_3$ at the backing face (46) and a diameter $d_4$ at the face adjacent to the outer face (50) of the shoe (22), and $$d_1=d_3-c_1$$

$$d_2=d_4-c_2 \text{ and}$$

$$d_2=d_3(2e-c_1)$$

where cis the clearance between the drive spigot (32) and the location hole (42) at the face of the location hole (42) adjacent to the backing face (46) when the shoe (22) is mounted on the second drive shaft (24) and $c_2$ is the clearance between the drive spigot (32) and the location hole (42) at the face of the location hole (42) adjacent to the outer face (50) when the shoe (22) is mounted on the second drive shaft (24).

2. A dual function powered oscillating hand tool according to claim 1 wherein the drive shaft (24) is formed with a section (28) having an end (36) which is closest to the drive spigot (32) characterized in that a flange (30) is located between the end (36) and the drive spigot (32).

* * * * *